US010563822B2

(12) United States Patent
Shia

(10) Patent No.: US 10,563,822 B2
(45) Date of Patent: Feb. 18, 2020

(54) LED MODULE AND LED LAMP

(71) Applicant: Ping Yeung Dennis Shia, Hong Kong (CN)

(72) Inventor: Ping Yeung Dennis Shia, Hong Kong (CN)

( * ) Notice: Subject to any disclaimer, the term of this patent is extended or adjusted under 35 U.S.C. 154(b) by 41 days.

(21) Appl. No.: 15/692,264

(22) Filed: Aug. 31, 2017

(65) Prior Publication Data

US 2018/0094776 A1 Apr. 5, 2018

(30) Foreign Application Priority Data

Sep. 30, 2016 (CN) ..... 2016 2 1098755

(51) Int. Cl.

| | |
|---|---|
| ***F21K 9/20*** | (2016.01) |
| ***F21V 21/03*** | (2006.01) |
| ***F21V 21/096*** | (2006.01) |
| ***E04B 9/00*** | (2006.01) |
| ***F21S 8/00*** | (2006.01) |
| ***G08B 17/10*** | (2006.01) |
| ***G08B 17/113*** | (2006.01) |
| ***F21S 8/04*** | (2006.01) |

(52) U.S. Cl.

CPC ..... *F21K 9/20* (2016.08); *E04B 9/006* (2013.01); *F21S 8/03* (2013.01); *F21S 8/04* (2013.01); *F21V 21/03* (2013.01); *F21V 21/096* (2013.01); *G08B 17/10* (2013.01); *G08B 17/113* (2013.01)

(58) Field of Classification Search

CPC .... F21S 8/03; F21S 8/04; F21V 21/03; F21V 21/096; F21K 9/20; E04B 9/006; G08B 17/10; G08B 17/113

See application file for complete search history.

(56) References Cited

U.S. PATENT DOCUMENTS

2010/0002432 A1* 1/2010 Romano ..... F21V 7/0008 362/235

* cited by examiner

*Primary Examiner* — Suezu Ellis

(74) *Attorney, Agent, or Firm* — Yue (Robert) Xu; Apex Attorneys at Law, LLP

(57) ABSTRACT

An LED module includes a module board. A boss coaxial with a central axis of the module board is provided on one side surface of the module board, and the boss is provided, in a direction of the central axis of the module board, with a through hole through which a central rod of an LED lamp fixture passes, a side wall of the boss is provided with a fastener hole to allow a fastener to be inserted into the fastener hole to abut against an outer wall of the central rod of the LED lamp fixture; and multiple screws are fixedly mounted on the other side surface of the module board and configured to be detachably connected to drip holes in a surface of the LED lamp fixture respectively. An LED lamp including the LED module is provided, which has a reduced cost.

20 Claims, 7 Drawing Sheets

LED MODULE AND LED LAMP

CROSS REFERENCE OF RELATED APPLICATION

The present application claims the priority to Chinese Patent Application No. 201621098755.0, titled "LED MODULE AND LED LAMP", filed on Sep. 30, 2016 with the State Intellectual Property Office of the People's Republic of China, the content of which application is incorporated herein by reference in its entirety.

FIELD

The present application relates to the technical field of lamps, more particularly to a light-emitting diode (LED) module, and further relates to an LED lamp.

BACKGROUND

Presently, a light source, a light source module and a lamp fixture are generally manufactured integrally in the manufacturing of traditional ceiling lamp or dome lamp, which thus can be directly used after plugging into electric supply. If the ceiling lamp or dome lamp is damaged, especially if the light source module or lamp fixture is damaged, the whole has to be replaced, which results in a large loss, reduces the service life of the lamp, and leads to waste. Further, the cost of the ceiling lamp or dome lamp or the like in the production process is increased, and disassembly and assembly are not convenient.

Therefore, a technical issue to be addressed presently by those skilled in the art is to improve the assembly convenience of the ceiling lamp or dome lamp or the like and reduce the loss when the lamp is damaged.

SUMMARY

In order to address the above technical issues, an LED module is provided according to the present application, which allows the ceiling lamp or dome lamp to be conveniently installed and have a reduced loss when the lamp is damaged.

For achieving the above objects, the following technical solutions are provided according to the present application.

An LED module, includes:

a module board;

a boss coaxial with a central axis of the module board and provided on one side surface of the module board; and multiple screws fixedly mounted on the other side surface of the module board and configured to be detachably connected to drip holes in a surface of the LED lamp fixture respectively;

the boss is provided, in a direction of the central axis of the module board, with a through hole, through which a central rod of an LED lamp fixture passes, a side wall of the boss is provided with a fastener hole to allow a fastener to be inserted into the fastener hole to abut against an outer wall of the central rod of the LED lamp fixture; and the screw is provided with a head away from the surface of the module board, the head of the screw has a diameter larger than a width of a rectangular portion of the drip hole and smaller than a diameter of a circular portion of the drip hole.

Preferably, the LED module further includes a spring sleeved on each of the screws, and a pad is arranged between the spring and the head of the screw. The spring has one end abutting against the pad and another end abutting against the other side surface of the module board.

Preferably, in the LED module, a screw rod portion of the screw is rotatable about a central axis of the screw, and a meander-shaped hook is provided on a side of the screw, to allow a terminal end of the meander-shaped hook to abut against the surface of the LED lamp fixture when the screw is inserted into the rectangular portion of the drip hole.

Preferably, the LED module further includes multiple magnets configured to attract the surface of the LED lamp fixture and having an adjustable distance from the surface of the LED module board.

Preferably, in the LED module, multiple fastening teeth are circumferentially provided on an inner surface of the boss to abut against the outer wall of the central rod of the LED lamp fixture.

Preferably, in the LED module, the module board is further provided with a smoke detector configured to detect an indoor smoke concentration.

Preferably, in the LED module, the module board is further provided with a WIFI module configured to receive a control command sent from a user or transmit a detected smoke concentration value to a client.

Preferably, in the LED module, the module board is further provided with a controller connected to LED lamp beads and the WIFI module and configured to control the LED lamp beads to emit light or be extinguished according to the control command.

Preferably, in the LED module, the module board is further provided with a power supply module configured to supply power to the LED lamp beads, the controller, and the WIFI module.

An LED lamp is further provided according to the present application, which includes the LED module as described in any one of the above aspects.

As can be seen from the above technical solution, the LED module according to the present application includes: a module board; a boss coaxial with a central axis of the module board and provided on one side surface of the module board; and multiple screws fixedly mounted on the other side surface of the module board and configured to be detachably connected to drip holes in a surface of an LED lamp fixture respectively. The boss is provided, in a direction of the central axis of the module board, with a through hole through which a central rod of the LED lamp fixture passes, a side wall of the boss is provided with a fastener hole to allow a fastener to be inserted into the fastener hole to abut against an outer wall of the central rod of the LED lamp fixture, the screw is provided with a head away from the surface of the module board, the head of the screw has a diameter larger than the width of a rectangular portion of the drip hole and smaller than the diameter of a circular portion of the drip hole.

The boss is provided with the through hole in the direction of the central axis of the module board through which the central rod of the LED lamp fixture passes, the LED module is connected to the LED lamp fixture by means of the through hole, and the fastener is inserted into the fastener hole to abut against the outer wall of the central rod of the LED lamp fixture, thus the central rod of the LED lamp fixture is fixed further by the fastener. By the rotation of the LED module, the screw is inserted into the circular portion of the drip hole in the surface of the LED lamp fixture, and then slides to the rectangular portion of the drip hole because the diameter of the head of the screw is smaller than the diameter of the circular portion of the drip hole. Since the diameter of the head of the screw is larger than the width of the rectangular portion of the drip hole, the LED module is detachably connected to the LED lamp fixture by means of the screws. Compared with the conventional technology, the LED module and the lamp fixture are separated into two parts which are detachably installed, and assembly and disassembly of the LED module and the lamp may not require screwing or unscrewing of the screws, thus the assembly and disassembly are simple and quick. When damaged, the LED module can be disassembled directly from the lamp fixture to be replaced, without requiring the overall replacement, and thus reducing the loss.

An LED lamp including the above LED module is further provided according to the present application, which has the effects described above.

BRIEF DESCRIPTION OF THE DRAWINGS

For more clearly illustrating embodiments of the present application or technical solutions in the conventional technology, drawings used in the description of the embodiments or the conventional technology will be briefly described hereinafter. Apparently, the drawings in the following description are merely embodiments of the present application, and for those skilled in the art, other drawings may be obtained based on the provided drawings, without making any creative efforts.

DETAILED DESCRIPTION

Hereinafter, the technical solutions in the embodiments of the present application will be described clearly and completely in conjunction with the drawings in the embodiments of the present application. Obviously, the described embodiments are merely a part of the embodiments of the present application, rather than all embodiments. All of other embodiments obtained by those skilled in the art based on the embodiments of the present application without creative efforts fall within the scope of the present application.

Figure 1:
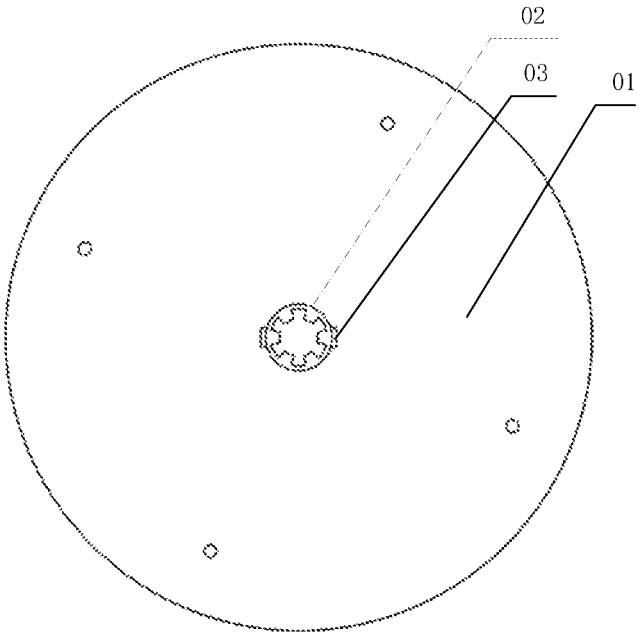
FIG. 1 is a top view of a front side of an LED module according to an embodiment of the present application.
Figure 2:
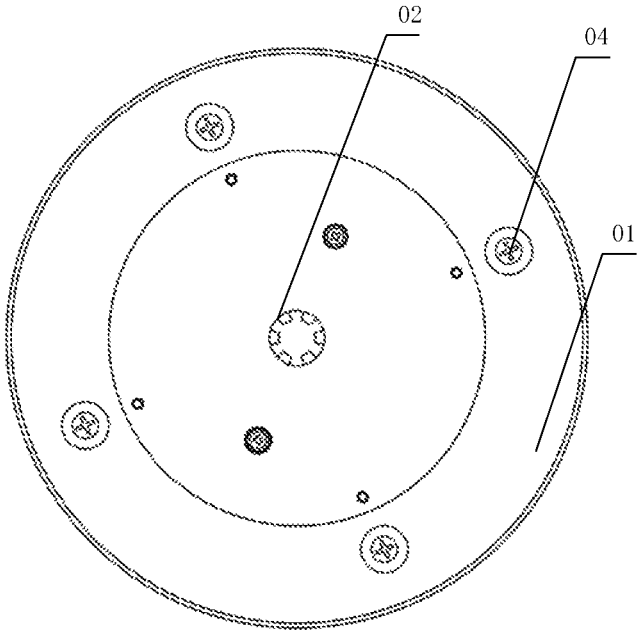
FIG. 2 is a top view of a back side of the LED module according to the embodiment of the present application.
Figure 5:
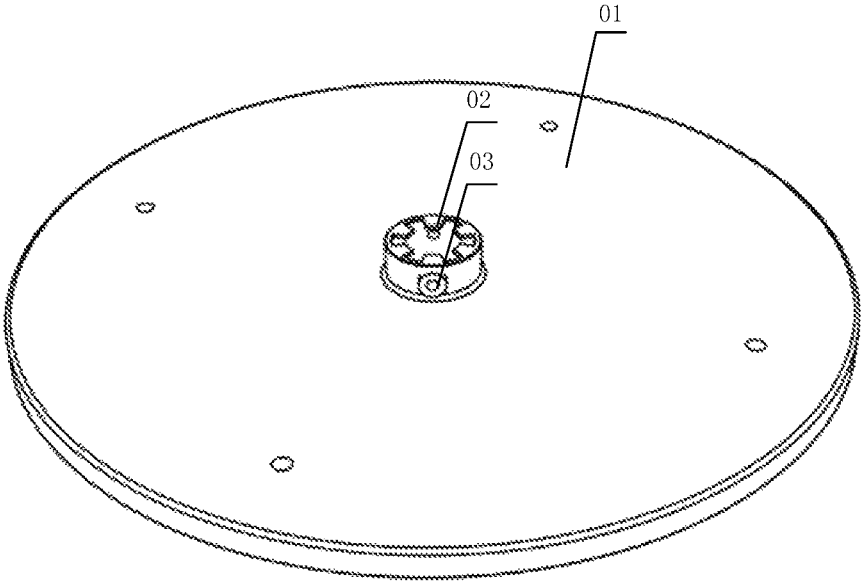
FIG. 5 is a front perspective view of the LED module according to the embodiment of the present application.
Figure 6:
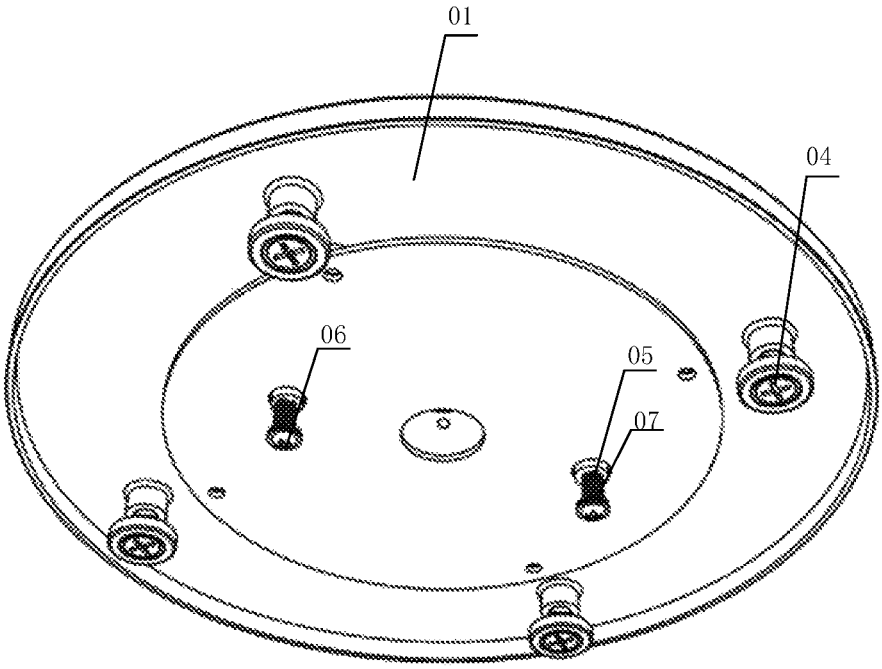
FIG. 6 is a rear perspective view of the LED module according to the embodiment of the present application.
Figure 7:
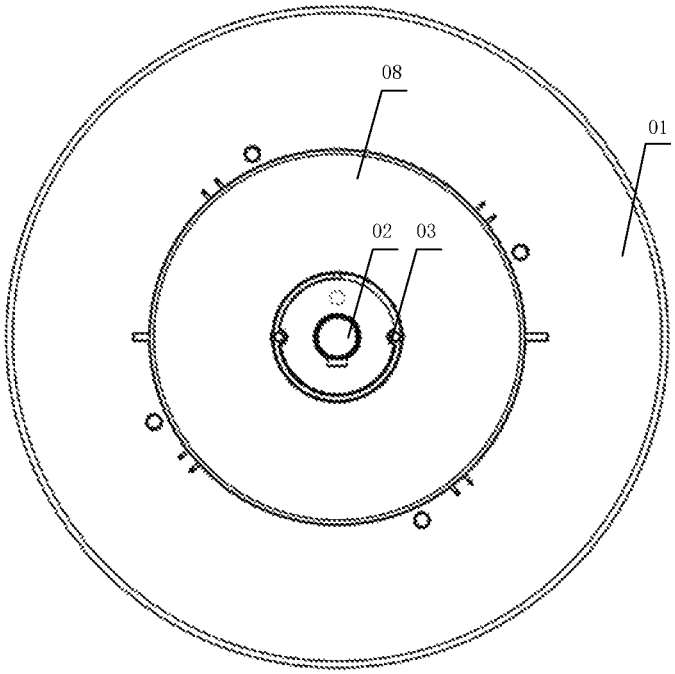
FIG. 7 is a top view of a front side of an LED module according to another embodiment of the present application.
Figure 8:
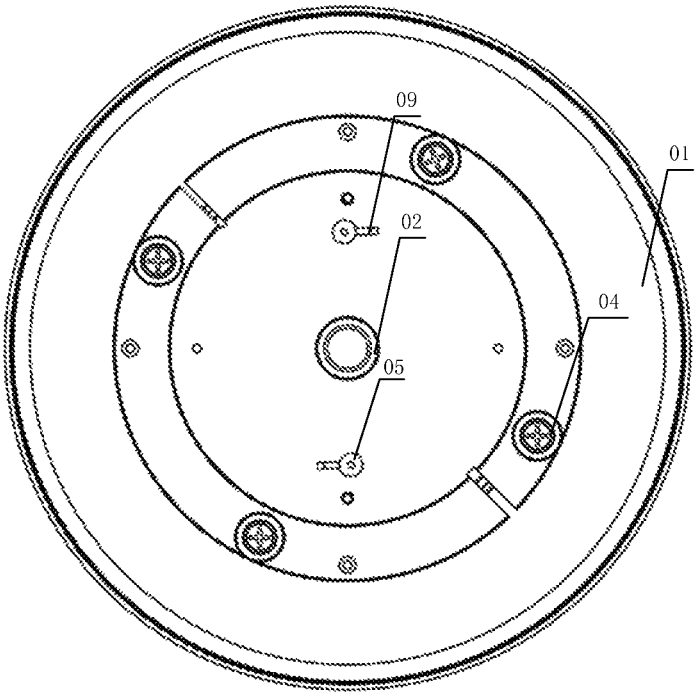
FIG. 8 is a top view of a back side of the LED module according to another embodiment of the present application.
Figure 11:
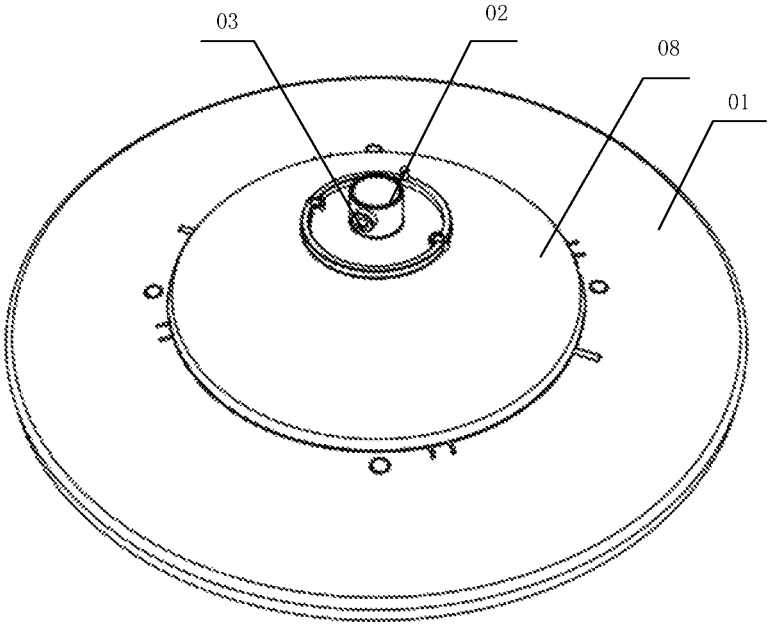
FIG. 11 is a front perspective view of the LED module according to another embodiment of the present application.
Figure 12:
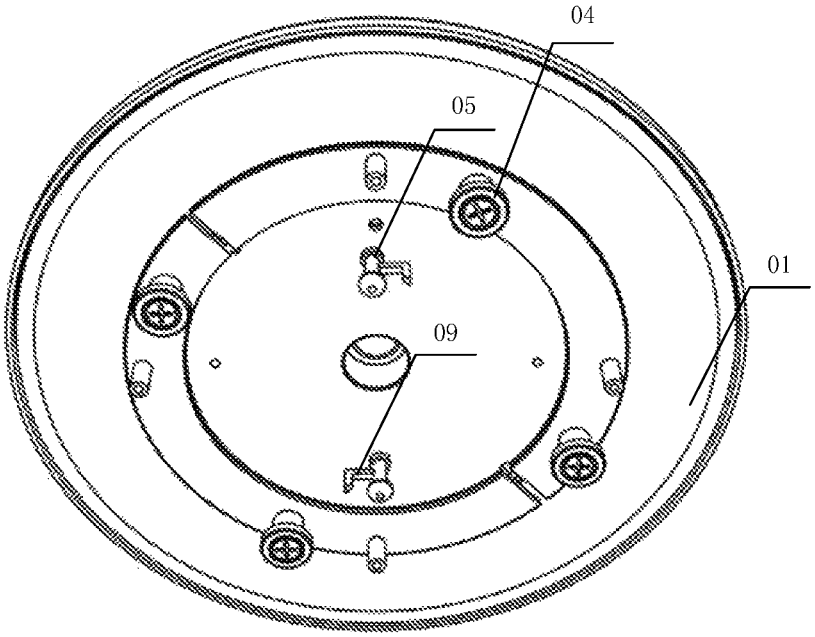
FIG. 12 is a rear perspective view of the LED module according to another embodiment of the present application.
Figure 13:
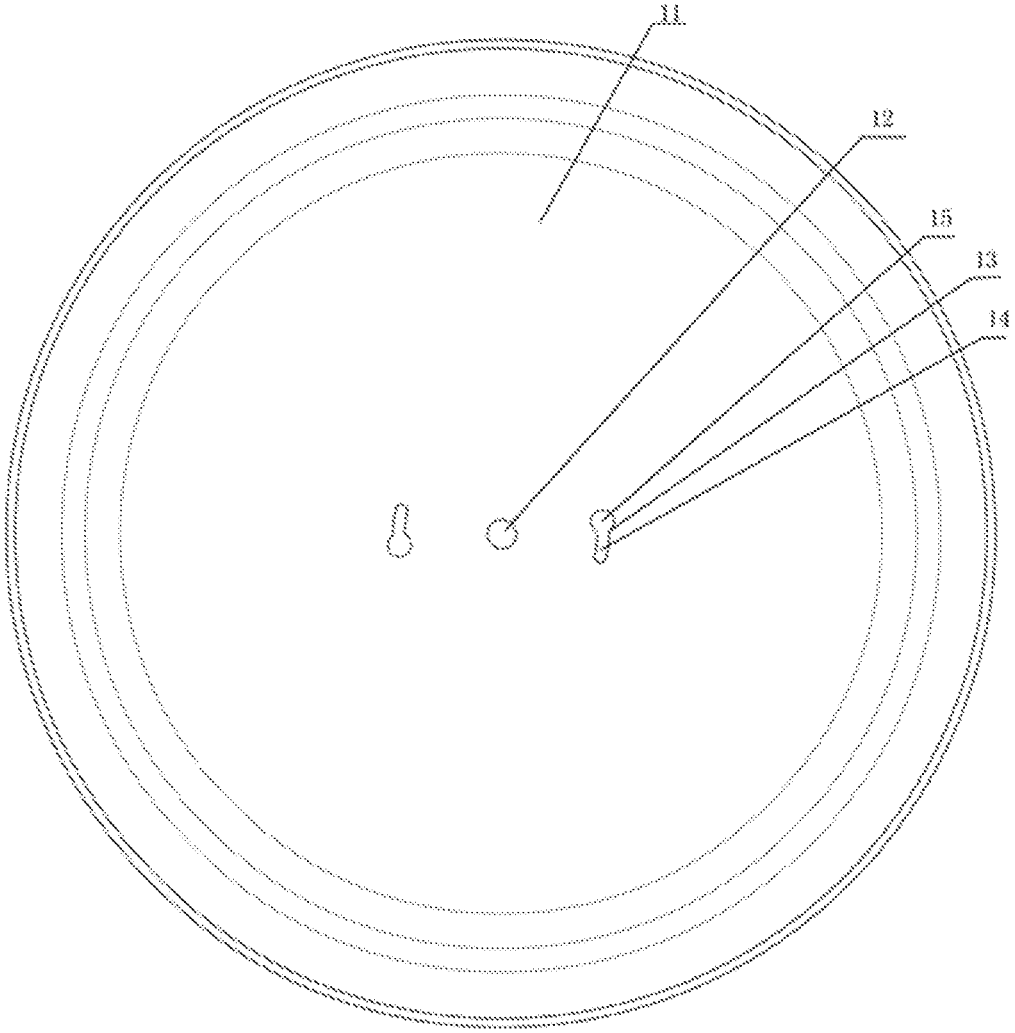
FIG. 13 is a front schematic view of an LED lamp fixture according to the embodiment of the present application.

Referring to the following drawings, FIG. 1 is a top view of a front side of an LED module according to an embodiment of the present application; FIG. 2 is a top view of a back side of the LED module according to the embodiment of the present application; FIG. 5 is a front perspective view of the LED module according to the embodiment of the present application; FIG. 6 is a rear perspective view of the LED module according to the embodiment of the present application; FIG. 7 is a top view of a front side of an LED module according to another embodiment of the present application; FIG. 8 is a top view of a back side of the LED module according to another embodiment of the present application; FIG. 11 is a front perspective view of the LED module according to another embodiment of the present application; and FIG. 12 is a rear perspective view of the LED module according to another embodiment of the present application.

An LED module is provided according to an embodiment, which includes:

a module board 01;

a boss 02 provided on one side surface of the module board 01 and coaxial with a central axis of the module board 01; and multiple screws 05 fixedly mounted on another side surface of the module board 01 and configured to be detachably connected to drip holes 13 in a surface of an LED lamp fixture 11 respectively;

the boss 02 is provided in a direction of the central axis of the module board 01 with a through hole, through which a central rod 12 of the LED lamp fixture 11 passes; a side wall of the boss 02 is provided with a fastener hole 03 such that a fastener is inserted into the fastener hole 03 to abut against an outer wall of the central rod 12 of the LED lamp fixture 11;

the screw 05 is provided with a head away from the surface of the module board 01. The head of the screw 05 has a diameter larger than the width of a rectangular portion 14 of the drip hole 13 and smaller than the diameter of a circular portion 15 of the drip hole 13.

The module board 01 may be designed to have a circular shape or a square shape as required. In this embodiment, the module board 01 having a circular shape is described as an example. Similarly, the boss 02 may have a circular cylinder shape or a square cylinder shape. In this embodiment, the boss 02 having the circular cylinder shape is described as an example. The numbers of the fastener and the fastener hole 03 are not limited, and two fastener holes 03 are arranged oppositely according to this embodiment.

Referring to the following drawings, FIG. 1 is a top view of a front side of an LED module according to an embodiment of the present application; and FIG. 2 is a top view of a back side of the LED module according to the embodiment of the present application.

The central rod 12 of the LED lamp fixture 11 can pass through the through hole at the center of the boss 02, an inner wall of the fastener hole 03 may be provided with screw threads, and an outer wall of the fastener is also provided with matching screw threads, such that the fastener can rotate along the inner wall of the fastener hole 03, till it abuts against the outer wall of the central rod 12 of the LED lamp fixture 11, to allow the LED module to be connected to the LED lamp fixture 11.

The way in which the fastener abuts against the central rod 12 of the LED lamp fixture 11 through the fastener hole 03 is not limited to the aforementioned case. In the case that each of the outer wall of the fastener and the inner wall of the fastener hole 03 is a surface that is smooth or has a certain roughness, the fastener is fixed by a snap fit in the case that the fastener passes through the fastener hole 03 to abut against the central rod 12 of the LED lamp fixture 11, and thus the central rod 12 of the LED lamp fixture 11 is connected to the LED module.

In order to prevent the aforementioned connection from being unstable, multiple screws 05, configured to be detachably connected to the drip holes 13 in the surface of the LED lamp fixture 11 respectively, are fixedly mounted on the other side surface of the module board 01, and the screw 05 is provided with a head away from the other surface of the module board 01. The diameter of the head of the screw 05 is larger than a width of a rectangular portion 14 of the drip hole 13, and smaller than a diameter of a circular portion 15 of the drip hole 13. By rotation of the LED module, the screw 05 is inserted into the circular portion 15 of the drip hole 13 in the surface of the LED lamp fixture 11, and then slides towards the rectangular portion 14 of the drip hole 13 because the diameter of the head of the screw 05 is smaller than the diameter of the circular portion 15 of the drip hole 13. Since the diameter of the head of the screw 05 is larger than the width of the rectangular portion 14 of the drip hole 13, the LED module is detachably connected to the LED lamp fixture 11 by means of the screws 05.

Compared with the conventional technology, the LED module and the lamp fixture are separated into two parts which are detachably installed, and the assembly and disassembly of the LED module and the lamp may not require screwing or unscrewing of the screws, thus the assembly and disassembly are simple and quick. When the LED module is damaged, it can be removed directly from the lamp fixture to be replaced, without requiring replacement of the overall lamp assembly, thus reducing the loss.

Figure 3:
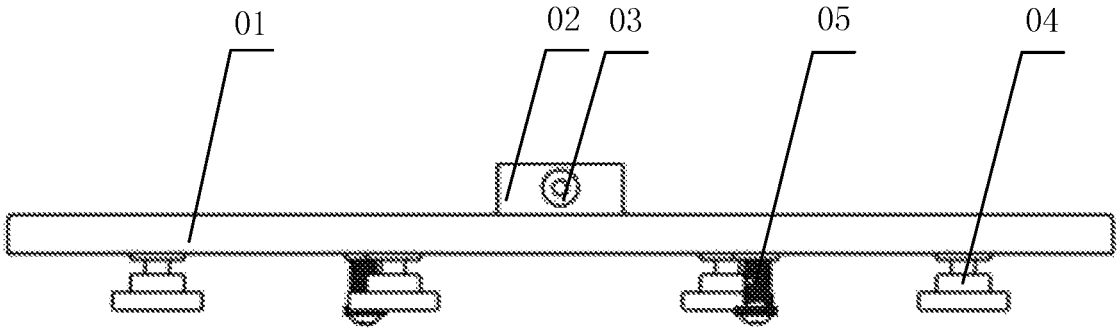
FIG. 3 is a side view of the LED module according to the embodiment of the present application.
Figure 4:
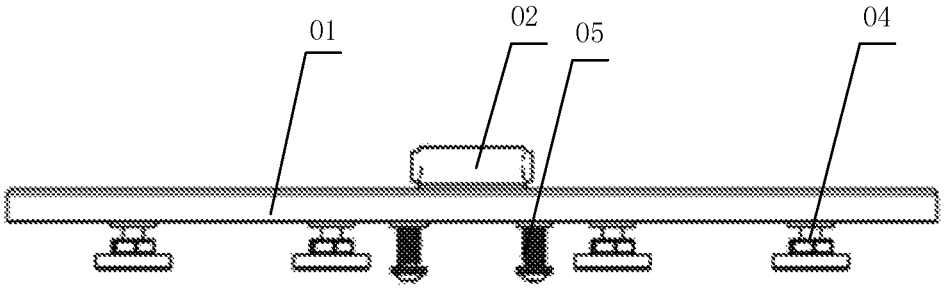
FIG. 4 is another side view of the LED module according to the embodiment of the present application.

Referring to the following drawings, FIG. 3 is a side view of the LED module according to the embodiment of the present application; and FIG. 4 is another side view of the LED module according to the embodiment of the present application.

On the basis of the aforementioned LED module, for making the connection between the module board 01 and the LED lamp fixture 11 more firm and preventing the connection between the drip hole 13 in the surface of the LED lamp fixture 11 and the screw 05 from loosening, the LED module further includes a spring 07 sleeved on each of the screws 05. A pad is provided between the spring 07 and the head of the screw 05. The spring 07 has one end abutting against the pad and another end abutting against the other side surface of the module board 01.

By rotating the LED module, the screw 05 is slid into the rectangular portion 14 of the drip hole 13. By abutting the spring 07 against the pad to come into contact with the surface of the LED lamp fixture 11, the head of the screw 05 contacts another surface of the LED lamp fixture 11, thus strengthening the connection between the LED module and the LED lamp fixture 11.

Figure 9:
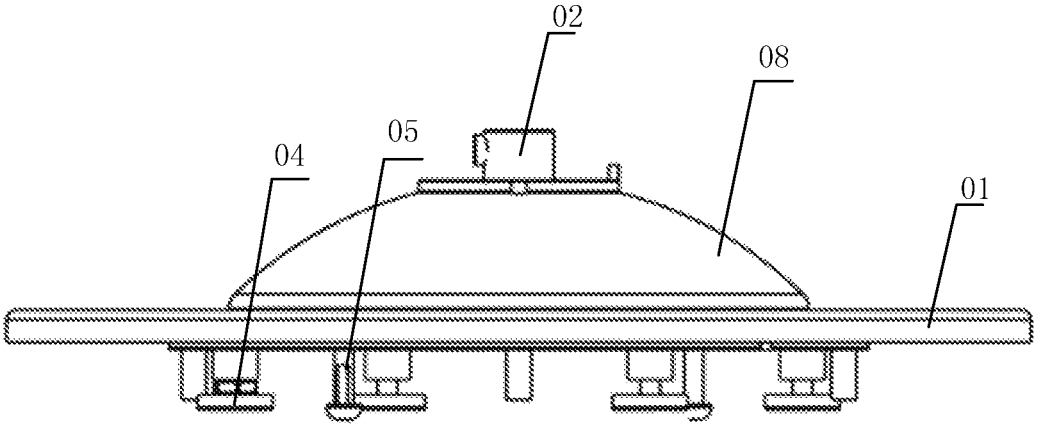
FIG. 9 is a side view of the LED module according to another embodiment of the present application.
Figure 10:
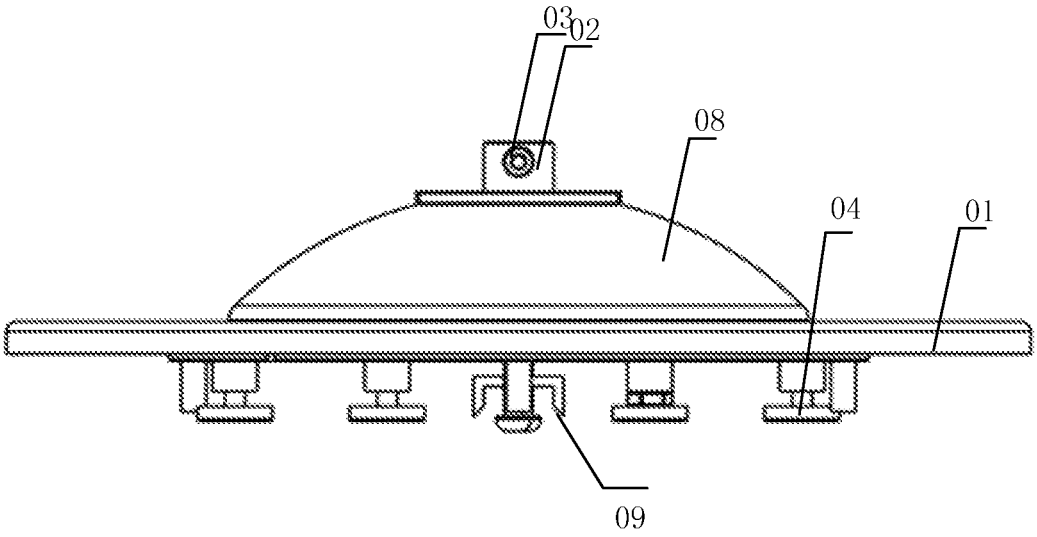
FIG. 10 is another side view of the LED module according to another embodiment of the present application.

Referring to the following drawings, FIG. 9 is a side view of an LED module according to another embodiment of the present application; and FIG. 10 is another side view of an LED module according to another embodiment of the present application.

On the basis of the above LED module, for making the connection between the module board 01 and the LED lamp fixture 11 to be more secure and preventing the connection between the drip hole 13 in the surface of the LED lamp fixture 11 and the screw 05 from loosening, a screw rod portion of the screw 05 is rotatable about a central axis of the screw 05, and a meander-shaped hook 09 is provided on a lateral side of the screw 05 such that a tail of the meander-shaped hook 09 abuts against the surface of the LED lamp fixture 11 when the screw 05 is inserted into the rectangular portion 14 of the drip hole 13.

In this embodiment, since the screw rod portion of the screw 05 is rotatable about the central axis of the screw 05, in use, the meander-shaped hook 09 firstly passes through the drip hole 13 via the rectangular portion 14, and then the meander-shaped hook 9 is rotated to allow another end of the meander-shaped hook 9 to abut against the surface of the LED lamp fixture 11. It is to be noted that the meander-shaped hook 09 is of an L-shape or U-shape, and has one end connected to the screw rod portion, and another end configured to abut against the surface of the LED lamp fixture 11, to strengthen the connection between the screws 05 and the LED lamp fixture 11 and prevent loosening from occurring under the action of an external force.

Further, the LED module also includes multiple magnets 04 configured to attract the surface of the LED lamp fixture 11 and having an adjustable distance from the surface of the LED module board 01.

The number of the magnets and the arrangement position of the magnets are not specifically limited. In this embodiment, four magnets 04 are circumferentially provided on the circular module board 01. The magnet 04 may be mounted to a terminal end of the screw 05, and the screw 05 is arranged on the surface of the LED module board 01. The distance of the magnet 04 from the module board 01 is adjusted by adjusting the height of the screw 05.

Further, in the aforementioned LED module, multiple fastening teeth are circumferentially provided on an inner surface of the boss 02 to abut against the outer wall of the central rod 12 of the LED lamp fixture 11.

The multiple fastening teeth are arranged towards the central axis of the boss 02, and the fastening teeth may be plastic, and function to clamp the LED central rod 12 to a certain degree to strengthen the fixation.

On the basis of the aforementioned LED module, the module board 01 is further provided with a smoke detector configured to detect an indoor smoke concentration.

Further, the module board 01 is further provided with a WIFI module configured to receive a control command sent from a user or transmit a detected smoke concentration value to the client.

Further, the module board 01 is further provided with a controller connected to LED lamp beads and the WIFI module and configured to control the LED lamp beads to emit light or be extinguished according to the control command.

Further, the module board 01 is further provided with a power supply module configured to supply power to the LED lamp beads, the controller, and the WIFI module.

In the aforementioned embodiment, the smoke detector, the WIFI module, the controller and the power supply module are all arranged on the surface of the LED module. The LED lamp beads are uniformly distributed around the center axis of the module board 01 on the surface of the module board 01 on the same side as the boss 02.

In another embodiment, a hemispherical structure 08 is provided between the boss 02 and the module board 01. The hemispherical structure 08 has a top end connected to a bottom surface of the boss 02 and a bottom end connected to the module board 01. The hemisphere structure 08 has a hollow inside configured to arrange the smoke detector, the WIFI module, the controller and the power supply module. The LED lamp beads are arranged on the surface of the module board 01 at a position where the hemispherical structure 08 is not located, and is arranged around the central axis of the module board 01 to be uniformly distributed on the surface of the module board 01 at the same side as the hemispherical structure 08 and the boss 02.

An LED lamp is further provided according to the present application, which includes the LED module as described in any one of the above aspects. The LED lamp has the above effects, which are not described here.

An LED lamp including the above LED module is further provided according to the present application, the LED module and the LED lamp fixture 11 are separately produced, which not only makes the installation convenient and reduces cost, but also reduces loss because the LED module and the LED lamp fixture 11 are disassembled depending on a damaged portion when the LED lamp is damaged, and then only the part including the damaged portion is replaced or maintained.

The above embodiments are described in a progressive manner. Each of the embodiments is mainly focused on describing its differences from other embodiments, and references may be made among these embodiments with respect to the same or similar portions among these embodiments.

The description of the embodiments disclosed herein enables the person skilled in the art to implement or use the present application. Various modifications to the embodiments will be apparent to the person skilled in the art, and the general principle herein can be implemented in other embodiments without departing from the spirit or scope of the present application. Therefore, the present application is not limited to the embodiments described herein, but should be in accordance with the widest scope consistent with the principle and novel features disclosed herein.

The invention claimed is:

1. A Light Emitting Diode (LED) module, comprising:

a module board;

a boss which is coaxial with a central axis of the module board and provided on one side surface of the module board; and a plurality of screws fixedly mounted on the other side surface of the module board and configured to be detachably connected to drip holes in a surface of an LED lamp fixture respectively;

wherein the boss is provided, in a direction of the central axis of the module board, with a through hole through which a central rod of the LED lamp fixture passes, a side wall of the boss is provided with a fastener hole to allow a fastener to be inserted into the fastener hole to abut against an outer wall of the central rod of the LED lamp fixture; and each of the screws is provided with a head away from the surface of the module board, the head of the screw has a diameter larger than a width of a rectangular portion of the drip hole and smaller than a diameter of a circular portion of the drip hole.

2. The LED module according to claim 1, further comprising a spring sleeved on outside of each of the screws, wherein a pad is arranged between the spring and the head of the screw, and the spring has one end abutting against the pad and another end abutting against the other side surface of the module board.

3. The LED module according to claim 2, further comprising a plurality of magnets configured to attract the surface of the LED lamp fixture and having an adjustable distance from the surface of the LED module board.

4. The LED module according to claim 1, wherein a screw rod portion of the screw is rotatable about a central axis of the screw, and a meander-shaped hook is provided on a side of the screw to allow a terminal end of the meander-shaped hook to abut against the surface of the LED lamp fixture when the screw is inserted into the rectangular portion of the drip hole.

5. The LED module according to claim 4, further comprising a plurality of magnets configured to attract the surface of the LED lamp fixture and having an adjustable distance from the surface of the LED module board.

6. The LED module according to claim 1, further comprising a plurality of magnets configured to attract the surface of the LED lamp fixture and having an adjustable distance from the surface of the LED module board.

7. The LED module according to claim 6, wherein a plurality of fastening teeth are circumferentially provided on an inner surface of the boss to abut against an outer wall of the central rod of the LED lamp fixture.

8. The LED module according to claim 7, wherein the module board is further provided with a smoke detector configured to detect an indoor smoke concentration.

9. The LED module according to claim 8, wherein the module board is further provided with a Wireless Fidelity (WIFI) module configured to receive a control command sent from a user or transmit a detected smoke concentration value to a client.

10. The LED module according to claim 9, wherein the module board is further provided with a controller connected to LED lamp beads and the WIFI module and configured to control the LED lamp beads to emit light or be extinguished according to the control command.

11. The LED module according to claim 10, wherein the module board is further provided with a power supply module configured to supply power to the LED lamp beads, the controller, and the WIFI module.

12. An LED lamp, comprising the LED module according to claim 1.

13. An LED lamp, comprising the LED module according to claim 2.

14. An LED lamp, comprising the LED module according to claim 4.

15. An LED lamp, comprising the LED module according to claim 6.

16. An LED lamp, comprising the LED module according to claim 7.

17. An LED lamp, comprising the LED module according to claim 8.

18. An LED lamp, comprising the LED module according to claim 9.

19. An LED lamp, comprising the LED module according to claim 10.

20. An LED lamp, comprising the LED module according to claim 11.

* * * * *